US005847625A

United States Patent [19]

Gillette

[11] Patent Number: 5,847,625

[45] Date of Patent: Dec. 8, 1998

[54] POWER DIVIDER DIRECTIONAL COUPLER

[75] Inventor: Marlin R. Gillette, Alden, N.Y.

[73] Assignee: TX RX Systems Inc., Angola, N.Y.

[21] Appl. No.: 831,923

[22] Filed: Apr. 2, 1997

[51] Int. Cl.[6] ..... H01P 5/12

[52] U.S. Cl. ..... 333/127; 333/128

[58] Field of Search ..... 333/109, 115–117, 333/121, 123, 127, 128

[56] References Cited

U.S. PATENT DOCUMENTS

| | | | |
|---|---|---|---|
| 3,761,843 | 9/1973 | Cappucci | 333/112 |
| 4,578,652 | 3/1986 | Sterns | 333/121 X |
| 4,652,880 | 3/1987 | Moeller et al. | 342/373 |
| 4,827,270 | 5/1989 | Udagawa et al. | 343/853 |
| 4,875,024 | 10/1989 | Roberts | 333/127 |
| 5,028,930 | 7/1991 | Evans | 342/373 |
| 5,467,063 | 11/1995 | Burns et al. | 333/125 |
| 5,543,762 | 8/1996 | Sigmon | 333/128 |
| 5,563,558 | 10/1996 | Mohwinkel et al. | 333/127 |

OTHER PUBLICATIONS

K. Nishikawa et al, IEEE Microwave and Guided Wave Letters; "Miniaturized Wilkinson Power Divider Using Three–Dimensional MMIC Technology", vol. 6, Oct. 1996, pp. 372–374.

B. Schiffman, IRE Transactions on Microwave Theory and Techniques; "A New Class of Broad–Band Microwave 90–Degree Phase Shifters", vol. MTT–6, Apr. 1958, pp. 232–237.

S. Koul et al, Micorwave and Millimeter Wave Phase Shifters; "Semiconductor and Delay Line Phase Shifters", vol. II, pp. 428–434.

J. Mialherbe, Microwave Transmission Line Couplers, pp. 47–52.

H. Howe, Jr., "Stripline Circuit Design", pp. 94–110.

K. Russell, IEE Transactions on Microwave Theory and Techniques; Microwave Power Combining Techniques:, vol. MTT–27, May 1979, pp. 472–478.

L. Parad et al, IEE Transactions on Microwave Theory and Techniques Split–Tee Power Divider, vol. MTT–13, Jan. 1965, pp. 91–95.

D. Pozar, Microwave Engineering; "The Wilkinson Power Divider", Pag 395–401.

*Primary Examiner*—Paul Gensler

*Attorney, Agent, or Firm*—Bean, Kauffman & Snyder

[57] ABSTRACT

A power divider directional coupler comprised of coupled transmission line sections at the beginning of each of a plurality of subdivided transmission lines wherein each subdivided transmission line has a unique characteristic impedance, even mode impedance and odd mode impedance. The coupled transmission line sections are shorted and function as quarter-wave transformers providing a center frequency electrical transmission phase of 90 degrees.

10 Claims, 2 Drawing Sheets

POWER DIVIDER DIRECTIONAL COUPLER

FIELD OF THE INVENTION

This invention relates to corporate feed structures for linear array antennas.

BACKGROUND OF THE INVENTION

The mechanical construction of linear array antennas requires a microwave power divider structure compatible with the space and volume available. The space and volume required by existing power dividers precludes the construction of small or miniaturized antenna applications with the exception of the reactive tee power divider which does not have isolation between output ports. This invention overcomes the prior art limitations. It springs from modifications of the standard Wilkinson style coupler calculated to allow the device to fit the space available and thereby minimizing power divider dimensional considerations in antenna design. The devices other than the Wilkinson style divider capable of a 3 dB split and isolation between output ports have not been found adaptable to the mechanical geometry and space available on transmission structures used as power divider housings necessary in the design of small or miniaturized linear array antennas. Devices found not capable of physical adaptation to small or miniaturized antenna-feed structures are the branch line, the rat race, and multisection Wilkinson couplers.

The impossibility of using prior art devices such as Wilkinson dividers in miniaturized antenna arrays are readily apparent in FIGS. 1 through 3. In these figures, note that the printed transmission lines are supported by substrates 10 which are necessarily relatively large with respect to contemporary miniature arrays because of the relationship between diameter of power divider ring and operational frequency. The basic Wilkinson prior art device of FIG. 1 includes an input 11, power divider quarter-wave length ring comprised of line sections 24 and 25, and impedance matching outputs 22 and 23. This results in a structure significantly longer than required when using the present invention as illustrated by FIG. 5. The prior art embodiment illustrated in FIG. 2 is even larger than the FIG. 1 embodiment due to the added compensation line segment 26. The output ends, 18 and 19, of the power divider rings are connected to output impedance matching segments and create a gap 20 which is bridged by a resistance in the present invention. FIG. 3 is an example of a prior art Wilkinson multisection hybrid adaptation incorporating an additional section comprised of transmission lines 28 and 29.

In addition to their geometry and size limitations, prior power dividers are not easy or inexpensive to produce. An accurate power split and impedance match to the 50 Ohm transmission lines interconnecting the power divider structure is required to minimize the power loss into the 100 Ohm isolation resistors in the Wilkinson style dividers. In the prior art this can be accomplished only through labor intensive adjustments after assembly. Thus a need exists for a device easily manufactured to reduce labor costs and to provide accurate power split without the need for any adjustment after assembly.

An example of a microwave power divider embodying the above short deficiencies is U.S. Pat. No. 5,467,063 issued to R. Burns et al on Nov. 14, 1995 for "Adjustable Microwave Power Divider". This system utilizes open transmission line stubs for trimming the power divider network, a labor intensive procedure which must be performed for each transmission line after manufacture of the array.

OBJECTIVES OF THE INVENTION

A primary objective of the present invention is to provide a Wilkinson style feed structure for linear array antennas utilizing coupled transmission line sections to accommodate the axial space available on the outside surfaces of the antenna feed structure.

A further objective is to provide an antenna feed structure with a center frequency electrical transmission phase of 90 degrees for the total electrical length of the coupled transmission line sections and the tees and turns required for connection.

Another primary objective of the present invention is to provide a Wilkinson style feed structure for linear array antennas utilizing coupled transmission line sections wherein the characteristic impedance of the impedance transformer action of the coupled transmission line section is from 50 to 100 Ohms.

Another objective of the present invention is to provide a microwave power divider for array antennas which does not require transmission line trimming or adjustment after manufacture.

Another objective of the present invention is to provide a microwave power divider for array antennas where center frequency can be set by changing one linear dimension.

A still further objective is to provide a power divider with a length-to-width ratio of at least 1:2.

SUMMARY OF THE INVENTION

A broad band, single section, in-line hybrid microwave power divider is provided with two transformers comprised of transmission phase quarter-wave length coupled transmission line sections in tee-connection orientation with a 50 Ohm input transmission line and a pair of 50 Ohm output transmission lines. The bandwidth of the device is limited by the bandwidth of the coupled transmission line sections which act as quarter-wave transformers having a coupling impedance range of 50 Ohms to 100 Ohms.

DESCRIPTION OF THE INVENTION

Figure 4:
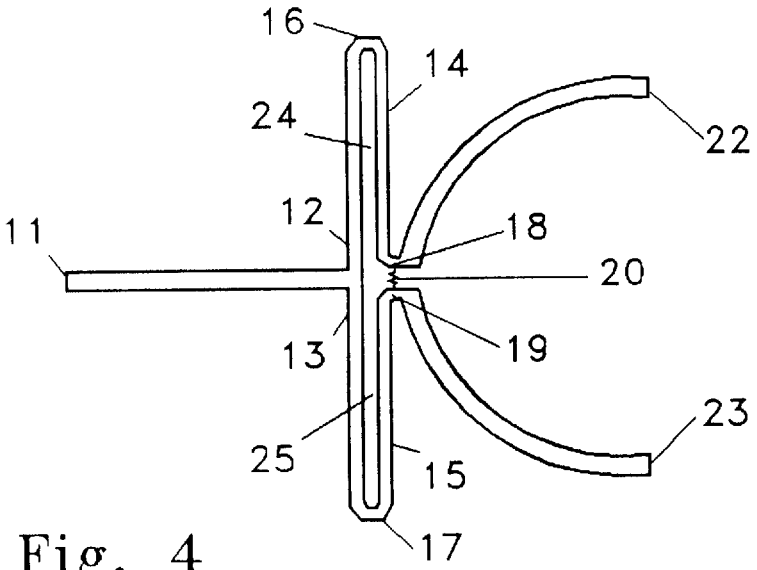
FIG. 4 is a schematic of the microwave power divider with the transformer coupled transmission line section of the invention configured to allow prototype measurements.
Figure 5:
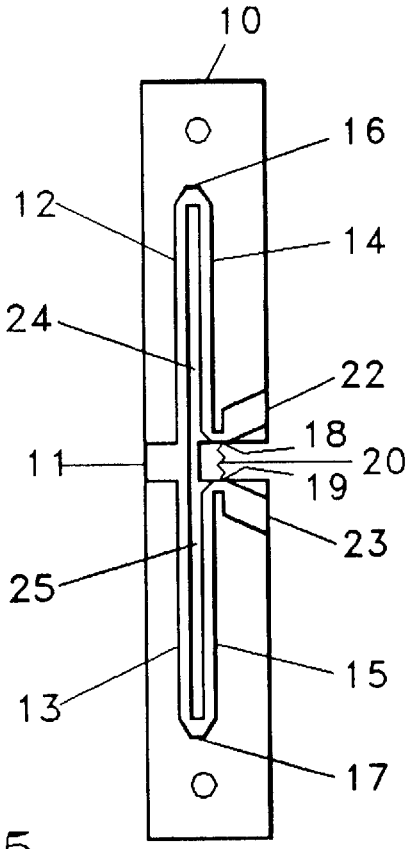
FIG. 5 illustrates the preferred embodiment of the invention configured to fit a microwave transmission assembly.

FIGS. 4 and 5 schematically illustrate standard single section applications of the invention. The 50 Ohm input transmission line 11 is terminated by a tee-connection to a pair of transmission line sections 12 and 13 which are coupled to transmission line sections 14 and 15 to create transmission phase quarter-wave length transformers 24 and 25. The ends of the coupled transmission line sections are shorted, 16 and 17, to provide a shorted coupled transmission line section with the characteristic impedance necessary for the impedance transformation from 50 Ohms to 100 Ohms required in a single section Wilkinson hybrid design.

The shorted coupled transmission line section maintains a 90 degree transmission phase shift over a bandwidth equal to that of a standard Wilkinson coupler. The output ends 18 and 19 of the coupled transmission line sections form a gap in which a 100 Ohm resistance 20 can be connected between the inputs to the 50 Ohm output transmission lines 22 and 23. The even mode and odd mode impedances, and therefore, the characteristic impedance, and the electrical length of the coupled transmission line sections 12 and 13 and 14 and 15 may be varied by changing the spacing between coupled transmission lines, the width of the transmission lines, and the physical length of the coupled transmission line sections. The bandwidth is a function of the coupled transmission line sections forming the impedance transformers 24 and 25.

The transmission lines used to create the invention may be any one or a mix of a variety of transmission means such as microstrip lines, strip lines, coaxial lines, edge-coupled coplanar waveguides with a ground plane, or coplanar waveguides with a ground plane.

The device is wider than long by at least a 1:2 ratio wherein the length dimension is in the direction of the input transmission line. In the typical preferred embodiment, the length-to-width ratio is 1:5 as illustrated by FIG. 5. This allows the power divider to be mounted on narrow surfaces such as the transmission assembly of a linear array antenna.

Figure 1:
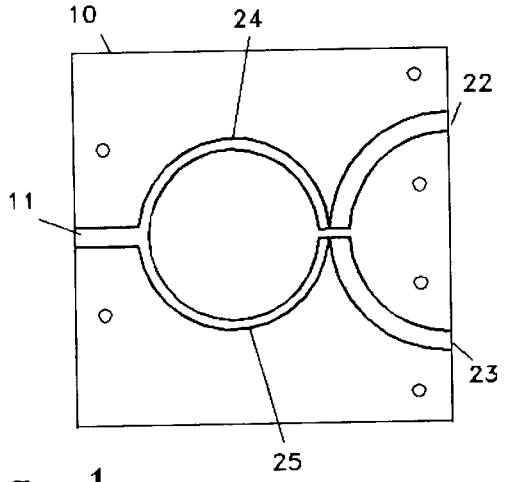
FIG. 1 illustrates a standard prior art physical embodiment of a power divider utilizing a ring configuration distinguishable from the invention in that no coupled transmission line sections are used as transformers.

FIG. 4 illustrates a typical implementation of the single section embodiment improvement over the prior art illustrated in FIG. 1. FIG. 5 illustrates the actual compact geometry of the invention as used in or on the transmission assembly of a linear array antenna. It has a compact geometry where the center frequency can be set by changing the length of the coupled transmission line sections creating the impedance transformers 24 and 25. It is structurally implemented on a Teflon-glass loaded substrate 10. To simplify comparison, the same reference elements in FIG. 4 and FIG. 5 are used to illustrate the graphically presented elements of FIG. 1 which are presented in approximate scale size.

Figure 2:
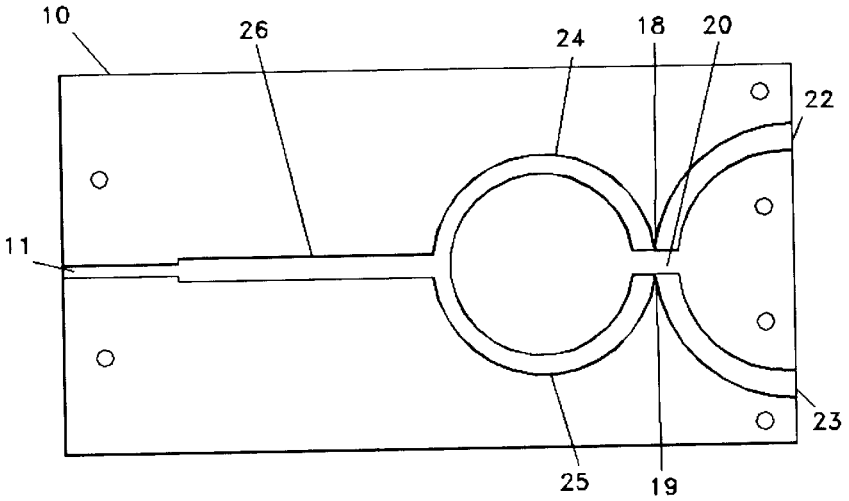
FIGS. 2 & 3 are multisection physical embodiments of the prior art designed to attain greater bandwidth using ring configurations.
Figure 3:
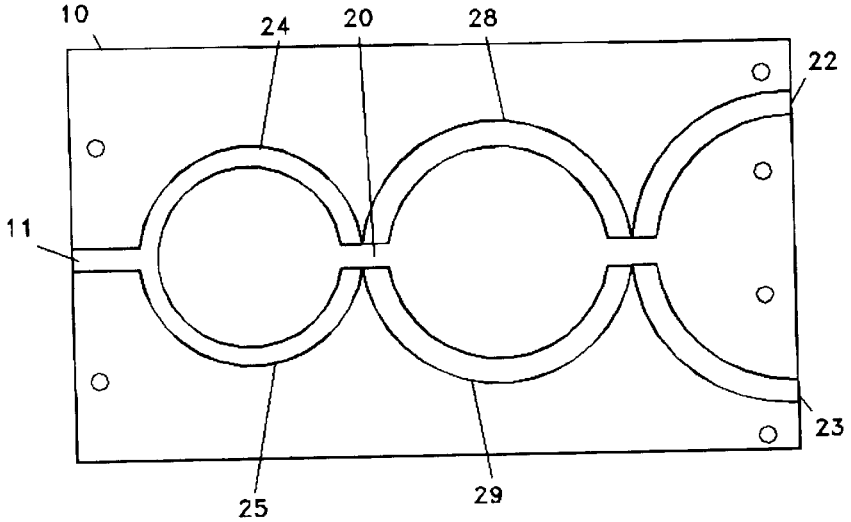

In the preferred embodiment of FIG. 5, the substrate 10 is an ARLON GT-250 Teflon-glass loaded substrate supporting a power divider coupler with input transmission line 11, gap resistance 20 and coupled transmission line sections 12, 14 and 16 and 13, 15 and 17, and output transmission lines 22 and 23. The prior art versions are the compensated Wilkinson of FIG. 2, and the multisection Wilkinson of FIG. 3. Neither prior art version can be adapted to a small or miniaturized transmission assembly of a linear array antenna due to their length-to-width ratios which are the reverse of the present invention.

While a preferred embodiment of this invention has been illustrated and described, variations and modifications may be apparent to those skilled in the art. Therefore, I do not wish to be limited thereto and ask that the scope and breadth of this invention be determined from the claims which follow rather than the above description.

What is claimed is:

1. A power divider, comprising:

an input transmission line;

a tee-connection including a first and a second transmission line terminating said input transmission line;

a first output transmission line coupled to said first transmission line by a first shorting means for effecting a first quarter-wave length impedance coupling transformer;

a second output transmission line coupled to said second transmission line by a second shorting means for effecting a second quarter-wave length impedance coupling transformer;

a first resistance means coupling the unshorted ends of said first and second output transmission lines;

a first input impedance matched output transmission line connected to said unshorted end of said first output transmission line; and a second input impedance matched output transmission line connected to said unshorted end of said second output transmission line.

2. A power divider as defined by claim 1 wherein said transmission lines are transmission means selected from the group consisting of microstrip lines, strip lines, coaxial lines, edge-coupled coplanar waveguides with a ground plane, and coplanar waveguides with a ground plane.

3. A power divider as defined by claim 1 wherein the width of said power divider is at least twice the length of said power divider, said length being defined as the dimensional vector parallel to said input transmission line.

4. A power divider as defined by claim 3 having a length to width ratio of approximately 1:5.

5. A power divider as defined by claim 3 wherein said transmission lines are transmission means selected from the group consisting of microstrip lines, strip lines, coaxial lines, edge-coupled coplanar waveguides with a ground plane, and coplanar waveguides with a ground plane.

6. A power divider as defined by claim 5 having a length to width ratio of approximately 1:5.

7. A power divider, comprising:

an input transmission line;

a first quarter-wave length impedance coupling transformer comprised of first coupled transmission line sections driven by said input transmission line;

a second quarter-wave length impedance coupling transformer comprised of second coupled transmission line sections driven by said input transmission line;

a first input impedance matched output transmission line connected to said first quarter-wave length impedance coupling transformer;

a second input impedance matched output transmission line connected to said second quarter-wave length impedance coupling transformer; and a resistance means coupling said first and second output transmission lines.

8. A power divider as defined by claim 7 wherein said transmission lines are transmission means selected from the group consisting of microstrip lines, strip lines, coaxial lines, edge-coupled coplanar waveguides with a ground plane, and coplanar waveguides with a ground plane.

9. A power divider as defined by claim 7 wherein the width of said power divider is at least twice the length of said power divider, said length being defined as the dimensional vector parallel to said input transmission line.

10. A power divider as defined by claim 9 wherein said transmission lines are transmission means selected from the group consisting of microstrip lines, strip lines, coaxial lines, edge-coupled coplanar waveguides with a ground planes and coplanar waveguides with a ground plane.

* * * * *